US005713280A

United States Patent [19]

Kelm et al.

[11] Patent Number: 5,713,280

[45] Date of Patent: Feb. 3, 1998

[54] DRIVE FOR DISTRIBUTOR ROLLERS IN AN INKING UNIT OF A ROTARY PRINTING MACHINE

[75] Inventors: Carsten Kelm, Mannheim; Rainer Klenk, Leon-Rot., both of Germany

[73] Assignee: Heidelberger Druckmaschinen Aktiengesellschaft, Heidelberg, Germany

[21] Appl. No.: 599,637

[22] Filed: Feb. 9, 1996

[30] Foreign Application Priority Data

Feb. 10, 1995 [DE] Germany ..... 195 04 426.6

[51] Int. Cl.[6] ..... B41F 7/02; B41F 31/14

[52] U.S. Cl. ..... 101/142; 101/349; 101/DIG. 38

[58] Field of Search ..... 101/248, 142, 101/143, 144, 145, 349, 350, 351, 352, 217, 218, DIG. 38

[56] References Cited

U.S. PATENT DOCUMENTS 4,914,981 4/1990 Hummel et al. .

FOREIGN PATENT DOCUMENTS 3814927 12/1989 Germany .
4022091 2/1991 Germany .
4231260 3/1994 Germany .

*Primary Examiner*—J. Reed Fisher
*Attorney, Agent, or Firm*—Nils H. Ljungman and Associates

[57] ABSTRACT

The present invention relates to a drive for distributor rollers in an inking-unit of a rotary printing machine comprising a central gearwheel driven by a printing unit-cylinder, and distributor rollers the drive gears of which are in mesh with the central gearwheel, each of the distributor rollers performing a lateral stroke, and the central gearwheel being provided with an adjusting possibility of varying the timing point of starting the lateral stroke with respect to the front end of the printing plate, and thus influencing the inking of the printing plate according to the respective subject to be printed.

20 Claims, 12 Drawing Sheets

DRIVE FOR DISTRIBUTOR ROLLERS IN AN INKING UNIT OF A ROTARY PRINTING MACHINE

BACKGROUND OF THE INVENTION

1. Field of the Invention

The present invention generally relates to a drive for distributor rollers in an inking unit of a rotary printing machine, the drive comprising a central gearwheel driven by a printing-unit cylinder, and distributor rollers having drive gears which are in mesh with the central gearwheel, each of the distributor rollers performing an axial stroke.

2. Background Information

A central gearwheel, such as that described immediately above, is known from German Patent No. 42 31 260 A1, in which the drive gears of distributor rollers are assigned to the central gearwheel. The distributor rollers have an axial drive and perform a stroke which cannot be influenced through the central gearwheel.

OBJECT OF THE INVENTION

It is an object of the present invention to provide adjusting possibilities for the distributor rollers in order to vary the time-point of starting the lateral stroke with respect to the front end of the printing plate, and thus to influence or vary the inking on the printing plate according to the respective subject to be printed.

SUMMARY OF THE INVENTION

According to at least one embodiment of the present invention, an object, such as described hereinabove, can be achieved in that the central gearwheel is designed as a double gearwheel, the first gearwheel being in mesh with a printing-unit cylinder, and the second gearwheel being in mesh with the drive gears of the distributor rollers; in that the second gearwheel is mounted on a journal; in that both gearwheels feature a respective internal toothing with a planetary gear having two rims meshing with the internal toothings and being mounted on the journal of the displace able second gearwheel; and, in that the two internal toothings with the respective rims of the planetary gear differ with respect to their number of teeth. By rotating the journal, this solution can make it possible to rotate the second gearwheel (being in mesh with the drive gears of the distributor rollers), with respect to the first gearwheel (being in mesh with a printing-unit cylinder), so that, through the axial drive of the distributor rollers, the phase position of the lateral stroke may be varied with respect to the front end of the printing plate. The differing number of teeth of the internal toothings and the two gear rims of the planetary gear can make it possible to perform a sensitive adjustment without having to change the design of the inking unit.

In at least one advantageous embodiment of the present invention, the journal can carry a spur gear for adjusting the point of reversal of the distributor roller, whereby the spur gear is derivable by a servomotor via an intermediate gearwheel and the spur gear rotates the journal together with the planetary gear. The servomotor drive can offer the pressman the possibility of changing the point of reversal of the distributor roller via the control console.

A further advantageous embodiment of the present invention is characterized in that the journal carries a bearing plate, that the servomotor is fastened to the bearing plate, and that there is provided an adjusting cylinder acting on the bearing plate and axially displacing the bearing plate together with the second gearwheel of the central gearwheel so that the planetary gear may be disengaged and the inking-unit drive may be brought to a standstill. Owing to the additional possibility of axially displacing the second gearwheel of the central gear, the entire inking unit may be stopped in a simple manner, since the other rollers of the inking unit would all be friction-driven by the distributor rollers.

In an additional advantageous embodiment of the present invention, the bearing plate features a guide slit, which guide slit, for the purpose of fixing the bearing plate against rotation, can engage a roller mounted so as to be attached to the frame. Furthermore, a rotary-position indicator can be assigned to the journal, and the rotary-position indicator can be driven via a pair of gearwheels. Thus, it is possible to detect the respective rotary position of the displace able second gearwheel in the control program of the machine so that, when reengaging the planetary gear in the interal toothing, the correct angle-of-rotation position can essentially always be given.

When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

One aspect of the present invention resides broadly in a printing press comprising: a frame; a plate cylinder for mounting a printing plate; the plate cylinder being rotatably mounted with respect to the frame; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; a blanket cylinder being rotatably mounted with respect to the frame and having means for being engaged with the plate cylinder during operation of the printing press; a distributor roller for being engaged with at least one of the inking rollers during operation of the printing press; the distributor roller having a rotational axis and being mounted, with respect to the frame, for rotation about the rotational axis; gear means for driving the distributor roller and the plate cylinder; means for displacing the distributor roller, simultaneously with the rotation of the distributor roller, in a direction substantially parallel to the rotational axis of the distributor roller, to laterally oscillate the distributor roller over a lateral stroke; the distributor roller having an angular position; the plate cylinder having an angular position; the angular position of the distributor roller being relative to the angular position of the plate cylinder; means for selectively and determinably varying the angular position of the distributor roller with respect to the angular position of the plate cylinder to thus vary the starting point of the lateral stroke of the distributor roller with respect to a predetermined portion of a printing plate disposed on the plate cylinder; the means for selectively and determinably varying comprising means for varying the angular position of the plate cylinder with respect to the distributor roller from a first printing job to an immediately succeeding, second, printing job during operation of the printing press without shutting down the printing press or intervening manually with the gear means of the printing press; and the means for varying the angular position of the plate cylinder with respect to the distributor roller from a first printing job to an immediately succeeding, second, printing job during operation of the printing press without shutting down the printing press or intervening manually with the gear means of the printing press comprising motor means for varying the angular position of the plate cylinder with respect to the distributor roller.

BRIEF DESCRIPTION OF THE DRAWINGS

An embodiment of the present invention is described in greater detail below and is schematically illustrated in the accompanying drawings, in which.

DESCRIPTION OF THE PREFERRED EMBODIMENT

Figure 1:
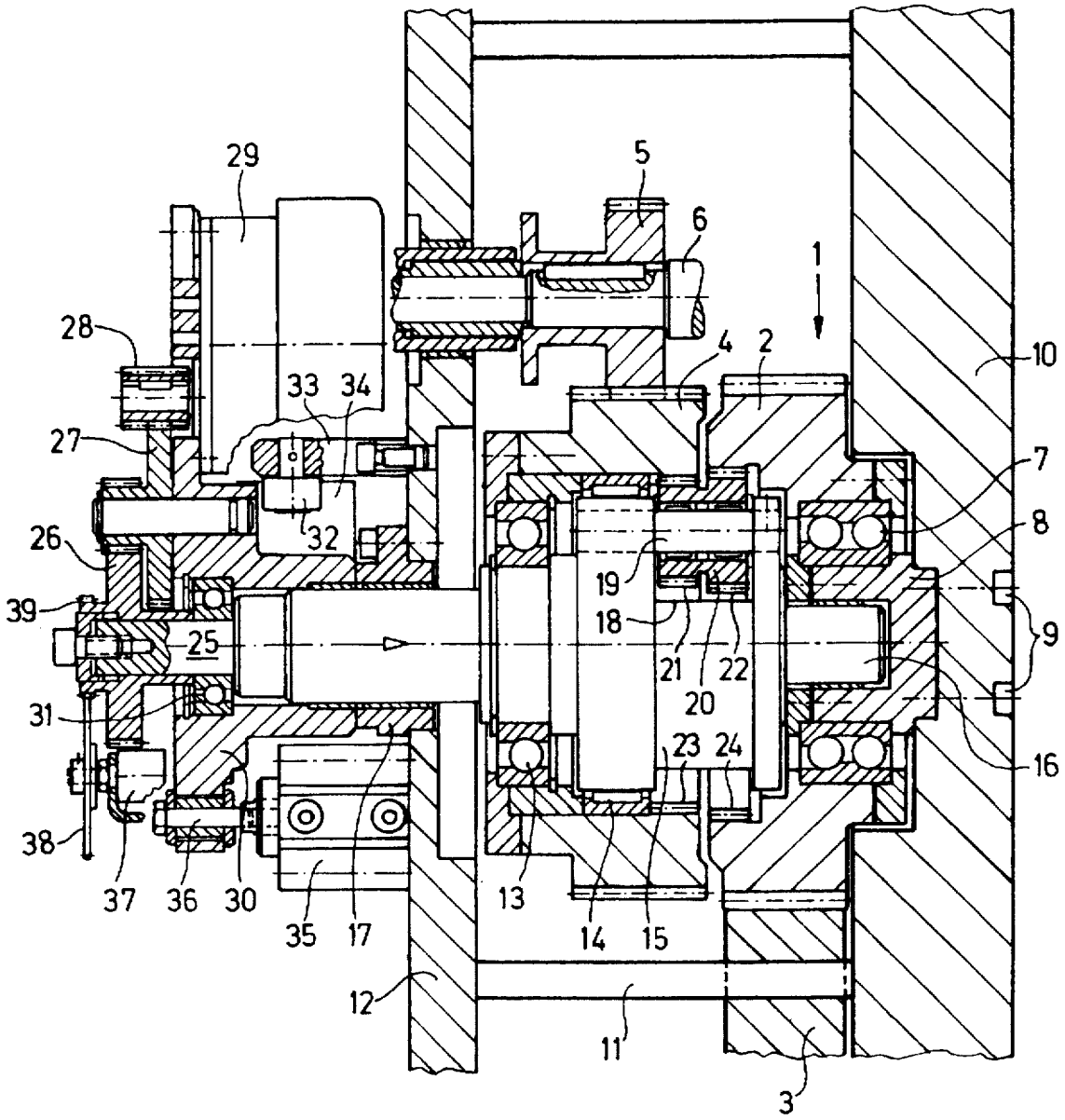
FIG. 1 shows the drive in an engaged position.

As shown in FIG. 1, the central gearwheel 1 can preferably be designed as a double gearwheel comprising a first gearwheel 2 meshing with a spur gear 3 of a printing-unit cylinder, and a second gearwheel 4 meshing with the drive gears 5 of the distributor rollers 6.

Via a ball bearing 7, the first gearwheel 2 can be rotatably mounted on a bearing body 8 fastened to the machine side frame 10 by means of screws 9. By means of support bolts 11, a bearing plate 12 can be fastened to the machine side frame 10 so as to be parallel therewith.

Via, respectively, a ball bearing 13 and a needle bearing 14, the second gearwheel 4 is preferably rotatably mounted on a journal 15, one end of which can be supported in the bearing body 8, via a journal 16, so as to be rotatable and axially displaceable. The other end of the journal 15 can be supported in a bearing 17 so as to be rotatable and axially displace able, the bearing 17 preferably being fastened to the bearing plate 12.

Furthermore, in a recess 18, a planetary gear 20 can be rotatably mounted on a bearing body 19 preferably provided at the journal 15, the planetary gear 20 featuring two gear rims 21, 22. Gear rim 21 can be in mesh with an internal toothing 23 of the second gearwheel 4. The second gear rim 22 of the planetary gear 20 can be in mesh with an internal toothing 24 of the first gearwheel 2. Both gear rims 21, 22 as well as both internal toothings 23, 24 preferably differ from each other with respect to the numbers of teeth so that a rotation of the journal 15 together with the planetary gear 20 can cause a rotation of the second gearwheel 4, with respect to the first gearwheel 2. This would be on the condition that there would be a drive connection between gearwheel 2 and spur gear 3. The differences in the numbers of teeth of the internal toothings 23, 24 can be compensated for by corresponding differences in the numbers of teeth of the two gearwheels 2, 4 so that, given a normal drive of the central gearwheel 1, the planetary gear 20 can serve merely as a clutch between the two gearwheels 2, 4, without effecting a transmission ratio.

In order to rotate the journal 15, a spur gear 26 can be fastened to the outer end 25 of the journal 15, the spur gear 26 preferably being connected, via an intermediate gearwheel 27, to the drive gear 28 of a servomotor 29. The servomotor 29 can be fastened to a bearing plate 30 mounted on the journal 15 by means of a ball bearing 31. Through the servomotor 29, the journal 15 may be rotated in order to adjust the point of reversal of the distributor roller 6, with respect to the front end of the printing plate.

A roller 32 which, via holding means 33, is preferably fastened to the bearing plate 12, can be provided to fix the bearing plate 30 against rotation. The roller 32 can engage in a guide slit 34 which can be formed in the bearing plate 30 and can essentially prevent the bearing plate 30 from rotating.

Figure 2:
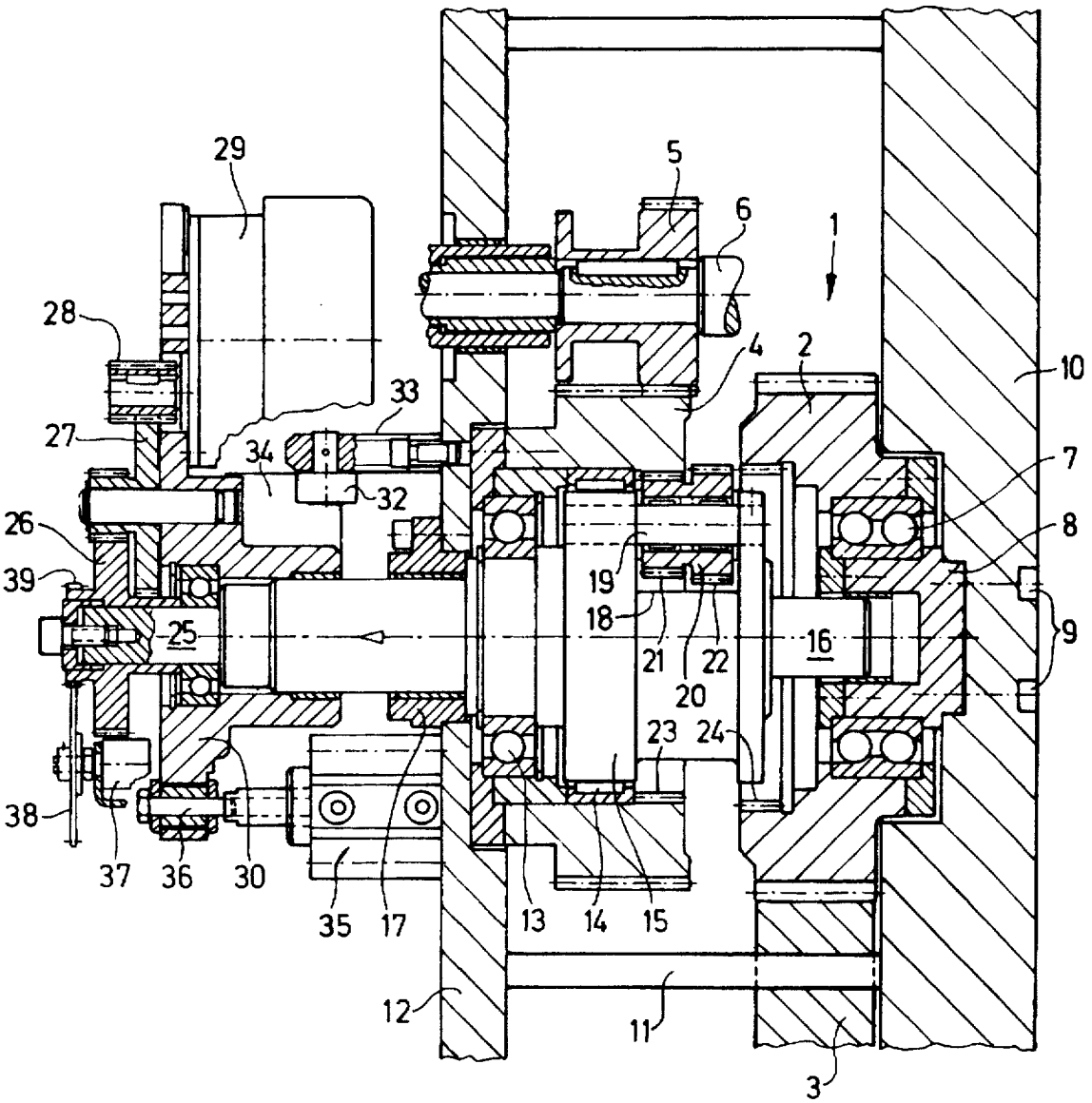
FIG. 2 shows the drive with the second central gearwheel being in a disengaged position.

An adjusting cylinder 35, fastened to the bearing plate 12, can be provided for axially adjusting the second gearwheel 4 via the journal 15. The adjusting cylinder 35, with piston rod 36, can act on the bearing plate 30 and displace the bearing plate 30 from the position indicated in FIG. 1 to the position indicated in FIG. 2, so that the gear rim 22 would be disengaged from the internal toothing 24. Thus, the first gearwheel 2 would not impart any rotary drive to the second gearwheel 4, so that the drive gears 5 of the distributor roller 6 meshing with the second gearwheel 4 are preferably no longer driven. In so doing, all inking-unit rollers can be brought to a standstill, while the printing-unit cylinders may still be driven.

Figure 1A:
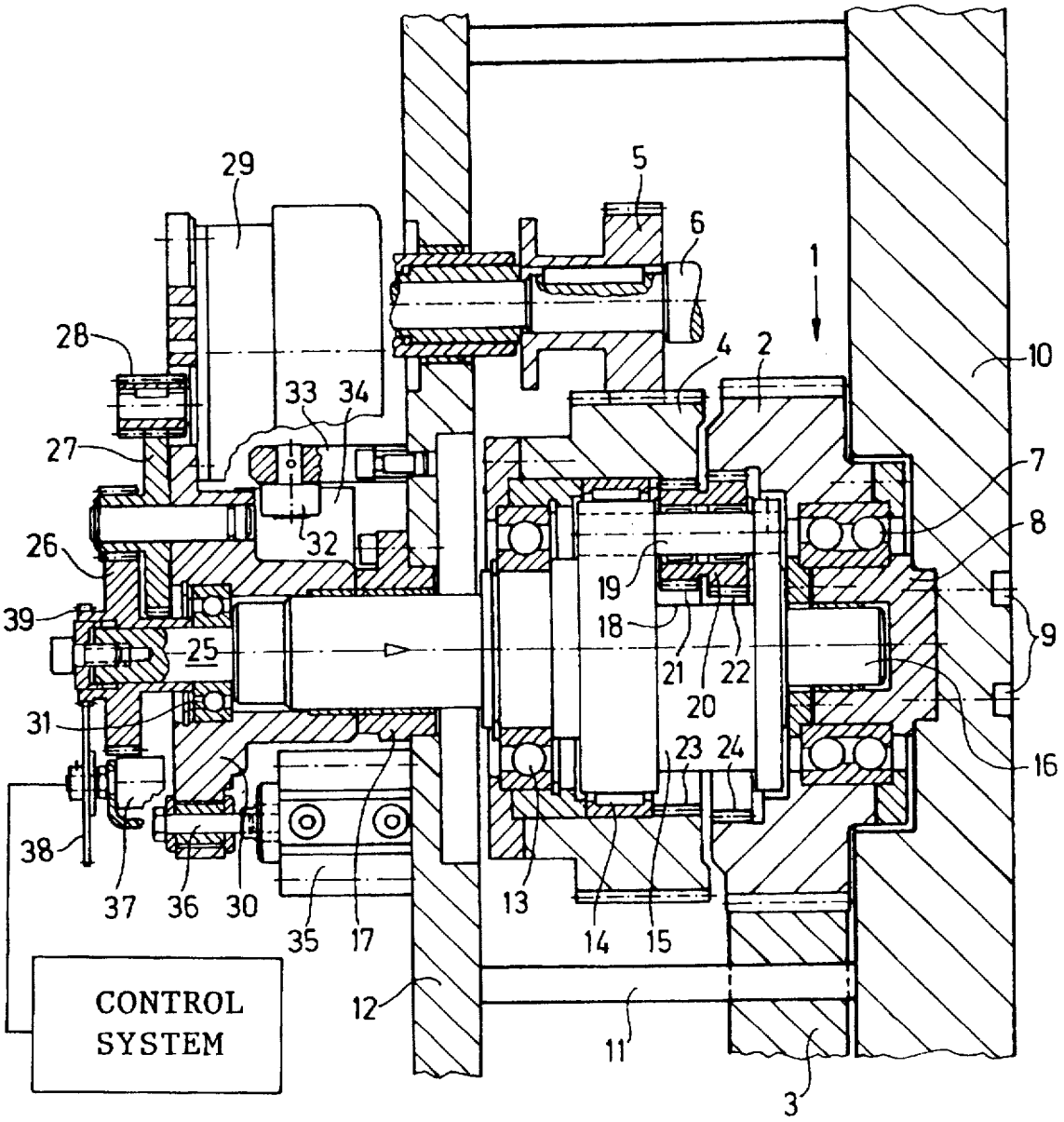
FIG. 1A is essentially the same as FIG. 1, but shows additional details.

In order to ensure that the gearwheel 22 is engaged into the internal toothing 24 at the same position, a rotary-position indicator 37 can be fastened to the bearing plate 30, the rotary-position indicator 37 carrying a gearwheel 38 meshing with a further gearwheel 39. Gearwheel 39, in turn, can be provided on the spur gear 26. Thus, it can essentially be possible for the rotary-position indicator 37 to detect the respective angular position of the journal 15, and to transmit the respective angular position of the journal 15 to the machine control system (shown schematically in FIG. 1A). An appropriate control of the servomotor 29 can essentially guarantee a reliable engagement into the desired angular position, irrespective of the position of the first gearwheel 2.

In accordance with at least one embodiment of the present invention, the second gearwheel 4, in other words, can be adjusted axially, to disengage the gear rim 22 from the internal toothing 24 of the first gearwheel 2, as follows:

The adjusting cylinder 35, by means of attachment of the piston rod 36 to the bearing plate 30, can move the bearing plate 30 in a direction essentially parallel to the longitudinal axis of the journal 16. This movement in the axial direction will essentially be carried out, then, toward and away from the side frame 10. As the adjusting cylinder 35 axially displaces the piston rod 36 away from the side frame 10, the piston rod 36, by means of attachment to the bearing plate 30, can move the bearing plate 30 away from the side frame 10. The bearing plate 30, mounted on the journal 15 by means of bearing 31, can then axially displace the journal 15, which axial displacement of the journal 15 is essentially in a direction away from the side frame 10. The second gearwheel 4, connected to the journal 15, can also, then, be moved in a direction away from the side frame 10. The planetary gear 20, being mounted to the second gearwheel 4, by means of bearing body 19, is also axially displaced in a direction away from the side frame 10, and the gear rim 22, of the planetary gear 20, can thus be disengaged from the internal toothing 24 of the first gearwheel 2.

Figure 3:
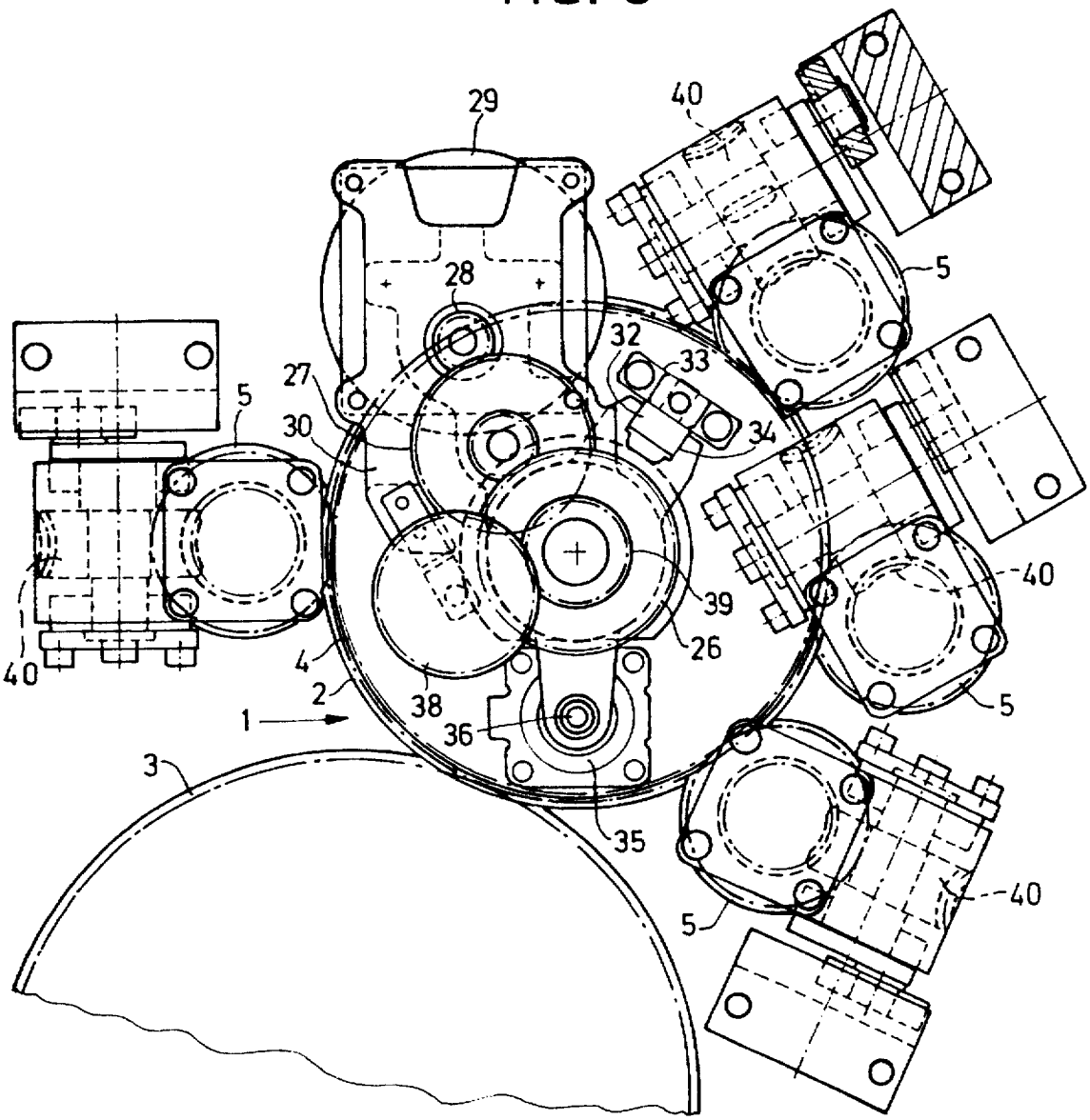
FIG. 3 is a front side elevational view of the drive.

FIG. 3 shows a number of drive gears 5 of distributor rollers disposed in star-form around the central gearwheel 1, with the gears 40 for the axial movement of the distributor rollers being only sketched in.

Figure 4:
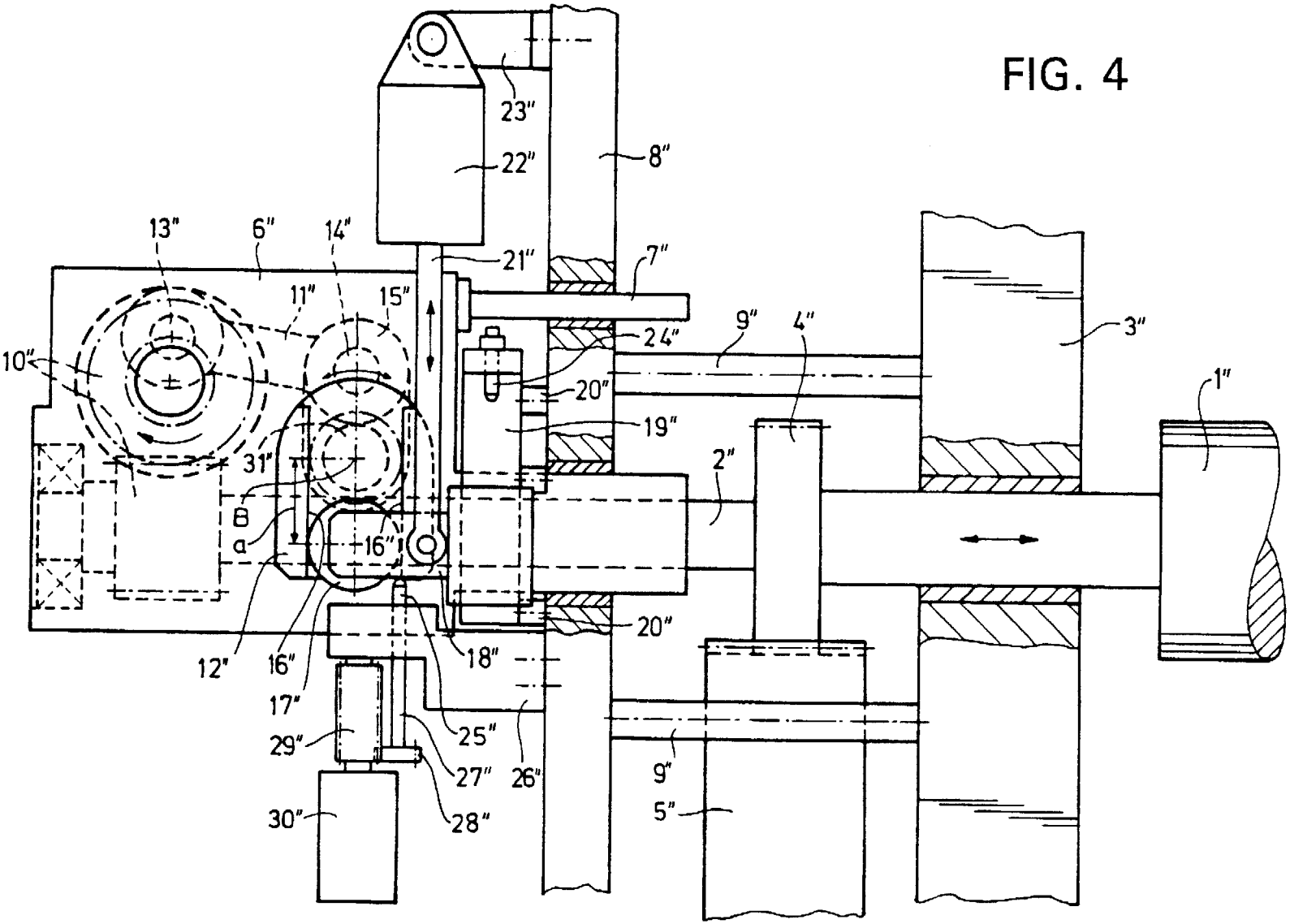
FIG. 4 shows a diagram of a device.

As shown FIG. 4, in accordance with at least one preferred embodiment of the present invention, a distributor roller 1" and its pivot 2" can preferably be supported in the machine side frame 3" so as to perform an axial reciprocating motion as well as a rotary motion. The drive of the distributor roller 1" can be effected via a spur gear 4" meshing with a spur gear 5" of the inking unit. Spur gear 4" would be driven by spur gear 5", thus imparting a rotary motion to the distributor roller 1".

At the end of the pivot 2" there can be mounted a housing 6", which housing 6" could preferably move axially back and forth together with the distributor roller 1". Via a guide bar 7", the housing 6" can essentially be fixed against rotation. According to the stroke of the distributor roller 1", the guide bar 7" would move axially back and forth in a bearing plate 8" preferably fastened to the machine side frame 3" via stay bolts 9". A worm gear 10", preferably driven by the pivot 2" of the distributor roller 1", can be located in the housing 6". The worm gear 10" would drive a connecting rod 11", which connecting rod 11", in turn, would cause a crank-type swing 12" to execute an oscillating motion. The crank-type swing 12", additionally, could be supported in the housing 6" so as to perform an essentially pendulum motion. In this case, the connecting rod 11" would preferably be mounted, with one end thereof, on a pin 13", the pin 13" preferably being provided on the worm gear 10" so as to be eccentrically offset, whereas the other end of the connecting rod 11" can be mounted on a pivot 14", which pivot 14" would be fastened to a swinging lever 5", which swinging lever 15", in turn, would drive the crank-type swing 12".

The crank-type swing 12" can preferably feature two contact surfaces 16" running essentially parallel to each other, between which two contact surfaces 16" there can be provided a roller 7" preferably fixed to a mounting support 18". The mounting support 18" can be displaced on a guide rail 19" essentially parallel to the machine side frame 3" and the bearing plate 8", respectively. The guide rail 19" can be fastened to the bearing plate 8" via bolts 20". Thus, the roller 17" can preferably be mounted on the machine side frame 3" via mounting support 18", guide rail 19" and bearing plate 8".

The thrust rod 21" of an adjusting means 22" can act on the mounting support 18" of the roller 17", with the adjusting means 22" preferably being supported on the bearing plate 8" via a supporting bearing 23". The adjusting means 22" may be a pneumatic cylinder, for example, via which the roller 17" may be displaced by a distance "a". The guide rail 19" may preferably feature a first stop 24" against which first stop 24" the mounting support 18" would abut, if the center of roller 17" would coincide with the point of rotation "B" of the crank-type swing 12". A second adjustable stop 25" can preferably be provided on a bearing body 26" and designed as a threaded spindle 27". The threaded spindle 27" can preferably extend through the bearing body 26" and preferably be connected to a servomotor 30" via a pair of spur gears 28" and 29", with the servomotor 30" being also mounted on the bearing body 26" (not illustrated). Via the servomotor 30", the second stop 25" may be changed with respect to the maximum position shown in FIG. 4, by turning the threaded spindle 27" until the center of roller 17" would coincide with the swivel point "B". Similar to the servomotor 30", the adjusting means 22" may be remote-controlled, as a result of which remote control a respective position of the roller 17" may be steplessly changed between both end positions.

By turning the distributor roller 1", a worm gear 10" can preferably impart to the connecting rod 11" a reciprocating motion, preferably causing the pin 14" and the swinging lever 15" to execute a pendulum motion, which pendulum motion, via an axle, spindle or shaft 31", would then be transmitted onto the crank-type swing 12". Thereafter, the crank-type swing 12' will preferably perform a pendulum motion about the point of rotation "B". Depending on the position of the roller 17" in the area "a", the pendulum motion of the crank-type swing 12" could be transformed into a reciprocating motion, while the roller 17" is firmly supported with respect to the machine side frame 3", seen in axial direction of the distributor roller 1". The pendulum motion of the crank-type swing 12" may now be imparted onto the point of rotation "B" and thus onto the housing 6", which housing 6" is preferably mounted on the pivot 2" of the distributor roller 1" so as to be rotatable but not axially displace able. Thus, the pivot 2" moves back and forth, with the stroke corresponding to the respective setting of stop 25". If roller 17" is positioned at point "B", essentially no axial motion will be transmitted onto the distributor roller 1".

Figure 5:
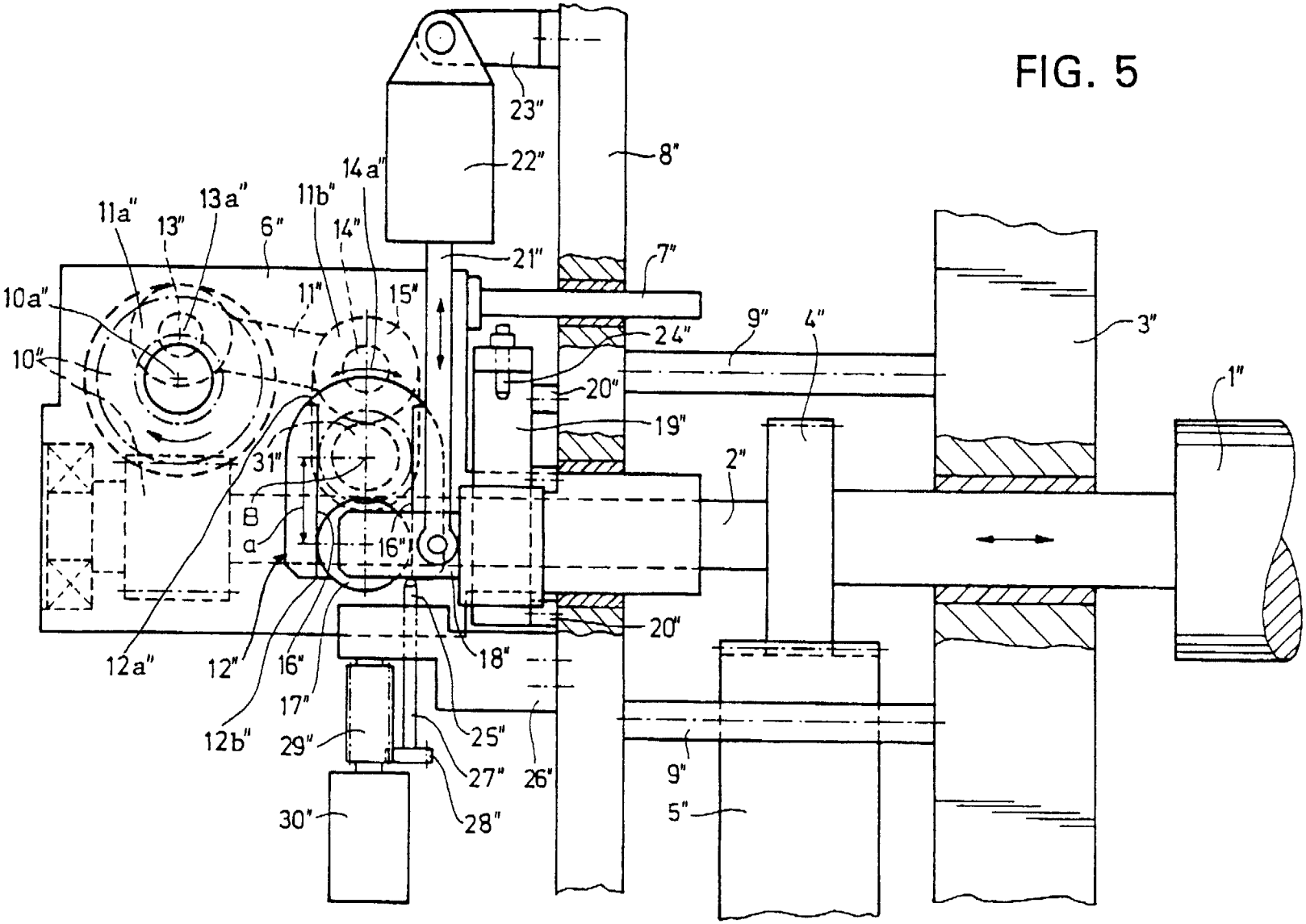
FIGS. 5 and 6 are essentially the same as FIG. 4, but show additional details.

As shown in FIG. 5, in one embodiment of the present invention, a first end 11*a*" of connecting rod 11" can be rotationally mounted by means of pin 13" to worm gear 10". The mounting of first end 11*a*" of connecting rod 11" is preferably offset from the axis of rotation 10*a*" of the worm gear 10". The axis of rotation 13*a*" of the first end 11*a*" of connecting rod 11", upon rotation of worm gear 10", essentially defines an orbital path around the axis of rotation 10*a*" of worm gear 10", thus causing the second end 11*b*" of connecting rod 11" to move. The second end 11*b*" of connecting rod 11" is preferably rotatably connected to swinging lever 15" by means of a pin 14". The crank-type swing 12" can be mounted on swinging lever 15". The assembly of pin 14", swinging lever 15" and crank-type swing 12" would preferably have a common axis of rotation "B"; in this embodiment, the axis of rotation 14*a*" at pin 14" is offset from the axis of rotation "B".

As the first end 11*a*" of connecting rod 11" orbits around the axis 10*a*" of worm gear 10", the second end 11*b*" of connecting rod 11", as noted above, preferably moves. The movement of the second end 11*b*" of connecting rod 11", however, would not then be an orbital movement, but an oscillating movement. By means of pin 14", the oscillating movement of connecting rod 11" is then preferably transferred to swing-type crank 12" in a manner, such that, for every movement of a first end 12*a*" of swing-type crank 12" in one direction, the axis of rotation "B" acts as a pivotal axis and a second end 12*b*" of swing-type crank 12" reacts with a pendulum motion from axis "B" and moves in a general linear direction substantially opposite to the direction of movement of a first end 12*a*" of crank-type swing 12". The housing 6" is mounted to pivot 2"; a second end 12*b*" of crank-type swing 12" would preferably transfer pendulum motion to pivot or shaft 2" via roller 17", which roller 17" is connected to mounting support 18", which mounting support 18" is connected to pivot 2". Thus, the pendulum motion of crank-type swing 12" would then be transferred to the housing 6" via the mounting of housing 6" on the pivot 2". Even though the crank-type swing 12" would preferably be rotatable about the axis "B", the crank-type swing 12" in contact with roller 17" preferably would not be axially displace able with respect to the bearing plate 8".

Figure 6:
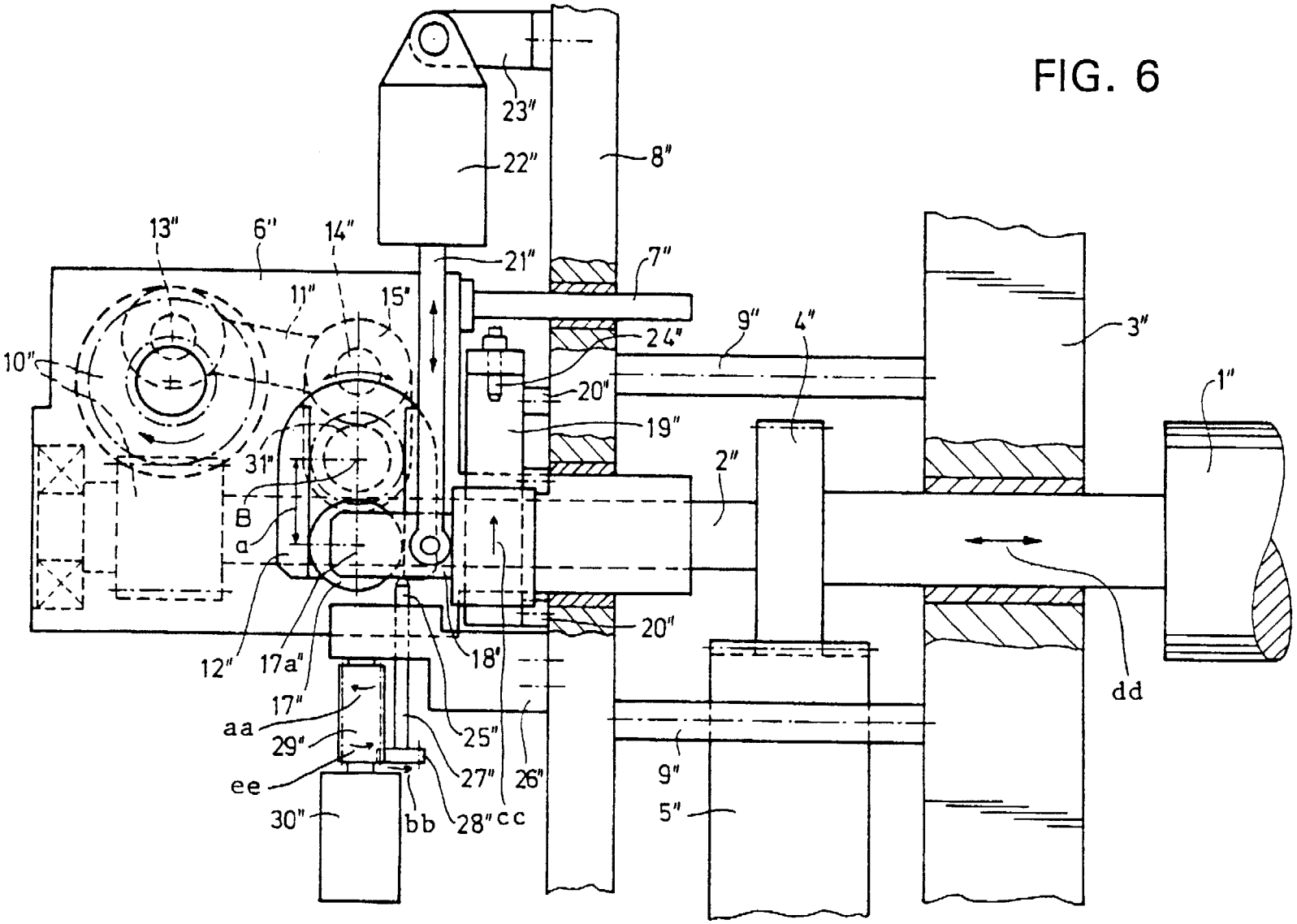
Figure 7:
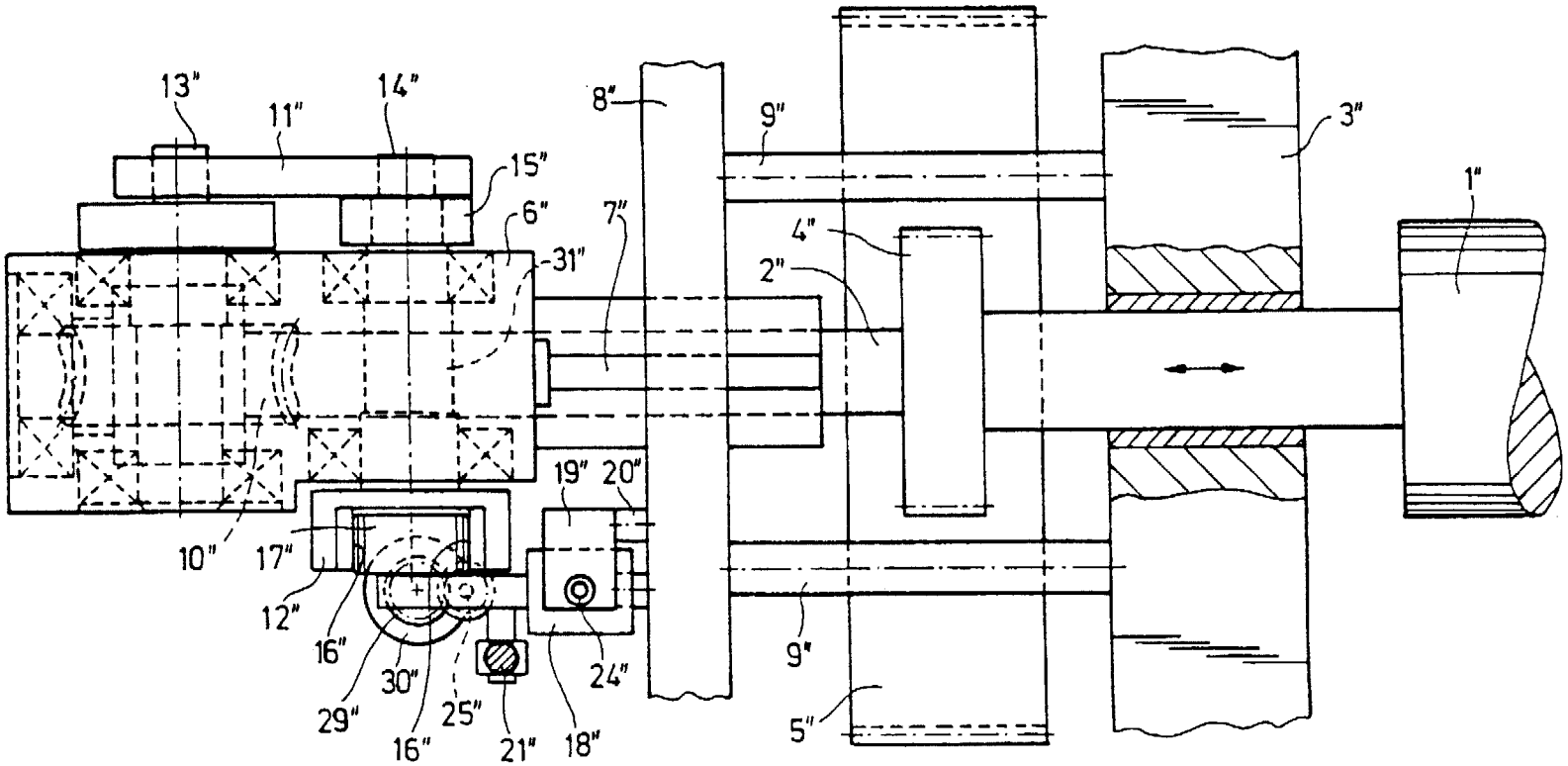
FIG. 7 is a side elevational view of a device.

FIG. 6 shows details of an embodiment of the present invention, particularly showing an example of the operation of stop 25". In this embodiment, spur gear 29", of servomotor 30", can preferably mesh with spur gear 28" of stop 25". The threaded spindle 27" of stop 25" can be right-hand threaded, with the bearing body 16" having mating threads where the threaded spindle 25" passes through bearing body 26". As servomotor 30" turns spur gear 29" in the direction of arrow "aa", the spur gear 28", being in mesh with spur gear 29", turns in the direction of arrow "bb", the direction of arrow "bb" in this embodiment being a right-hand direction. The threaded spindle 25" is then driven in direction of arrow "cc". The stop 25" would then engage mounting support 18", and mounting support 18", being guided by guide rail 19", would thus be adjusted in the direction of arrow "cc" as stop 25" moves in the direction of arrow "cc". Roller 17" is mounted on mounting support 18" and moves with mounting support 18"; thus, as mounting support 18" moves in the direction of arrow "cc", roller 17" moves likewise. The axis of rotation 17*a*" of roller 17", then, approaches the point of rotation "B" as roller 17" moves in the direction indicated by arrow "cc", thus shortening the distance "a". As distance "a" shortens, the longitudinal distance of travel, or axial stroke "dd" of roller 1" lessens. According to this embodiment, as spur gear 29" would turn in the direction of arrow "ee", the process as described herein would be reversed, thus lengthening the axial stroke "dd" of roller 1".

In a variant embodiment of the operation of stop 25", the threaded spindle 27" could be left-hand threaded; in this case, spur gear 29" would turn in direction "ee" in order to shorten the axial stroke "dd" of roller 1", as described in the embodiment hereinabove.

Figure 8:
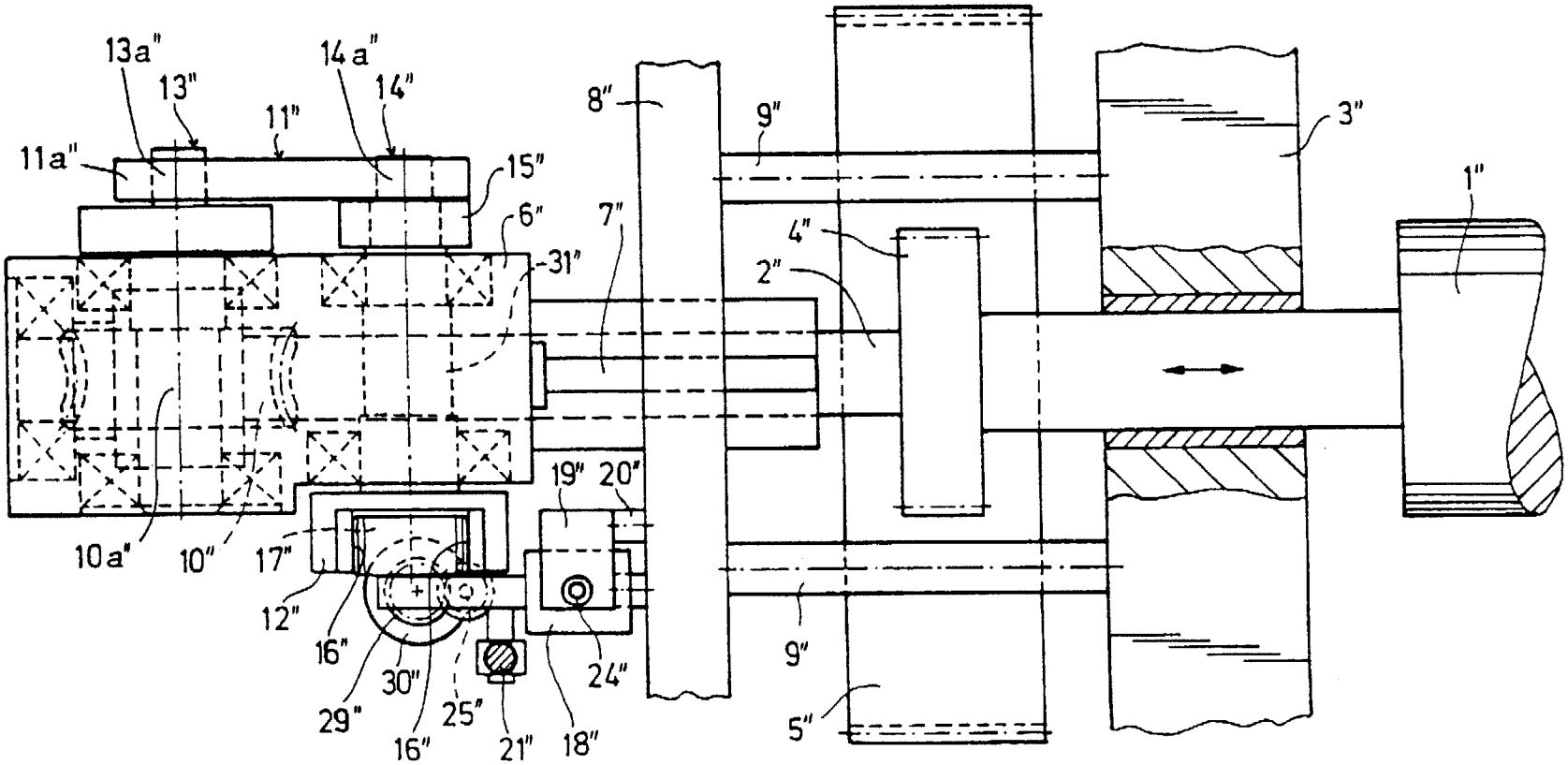
FIG. 8 is essentially the same as FIG. 7, but shows additional details.

Referring now to FIG. 8, the connecting rod 11" is shown, with the first end 11*a*" of connecting rod 11" being rotatably connected to worm gear 10" by means of pin 13". The second end 11*b*" of connecting rod 11" is rotatably connected by means of pin 14" to swinging lever 15"; swinging lever 15", in turn, is fixedly connected to the axle, shaft, or spindle 31". The axle, shaft, or spindle 31" is fixedly connected with swinging lever 15", and swinging lever 15" is fixedly connected with swing-type crank 12". The combination of the axle, shaft, or spindle 31", swinging lever 15", and swing-type crank 12" essentially acts, therefore, as a single operating unit; axis "B" essentially being the common axis of rotation for the aforementioned combination.

Figure 9:
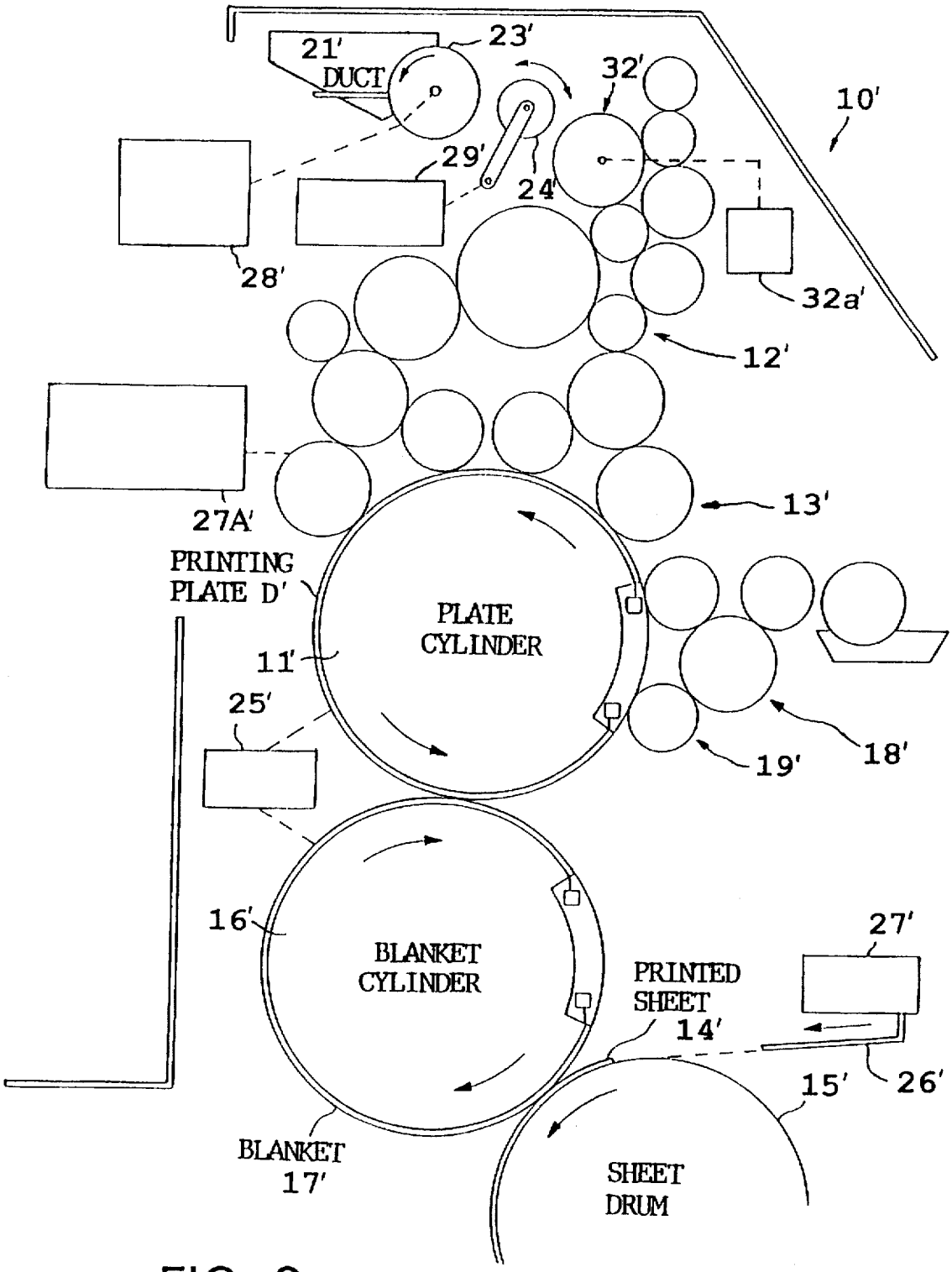
FIG. 9 illustrates a print stand, or printing unit, of a rotary printing press.

FIG. 9 illustrates a rotary print stand 10' of a rotary printing press which can employ a distributor roller displacement arrangement according to the present invention. Rotary print stand 10' generally includes: a plate cylinder 11' for having mounted thereon a printing plate D'; an inking unit 12' which includes ink applicator rollers 13' for applying ink to the printing plate an ink profile; a dampening (or wetting) unit 18' having dampening applicator rollers 19' for transferring a dampening agent to the printing plate D', a blanket cylinder 16' carrying a rubber blanket 17' for receiving an ink impression from the printing plate D', and a sheet drum 15' for carrying a printed sheet 14' onto which the ink impression carried by blanket 17' is transferred. A duct roller 23' is typically mounted adjacent to ink duct 21'. Typically, ink is transferred from duct roller 23' to inking unit 12' by means of a vibrator roller 24' which oscillates to successively pick up ink from duct roller 23' and deposit the same on a roller 32' of inking unit 10'. Typically, the printing stand 10' will also include auxiliary mechanisms such as, for example, a duct roller drive 28', a vibrator roller drive 29', an applicator roller throw-off 27A' for lifting the ink applicator rollers 13' off of the printing plate, a press drive 25' and a sheet feed 27' for supplying the sheets to be printed 26' to sheet drum 15'.

With relation to FIG. 9, roller 32' may be a distributor roller having an arrangement for adjusting the same, indicated at 32*a*, such as has been described heretofore with relation to FIGS. 4–8.

Figure 10:
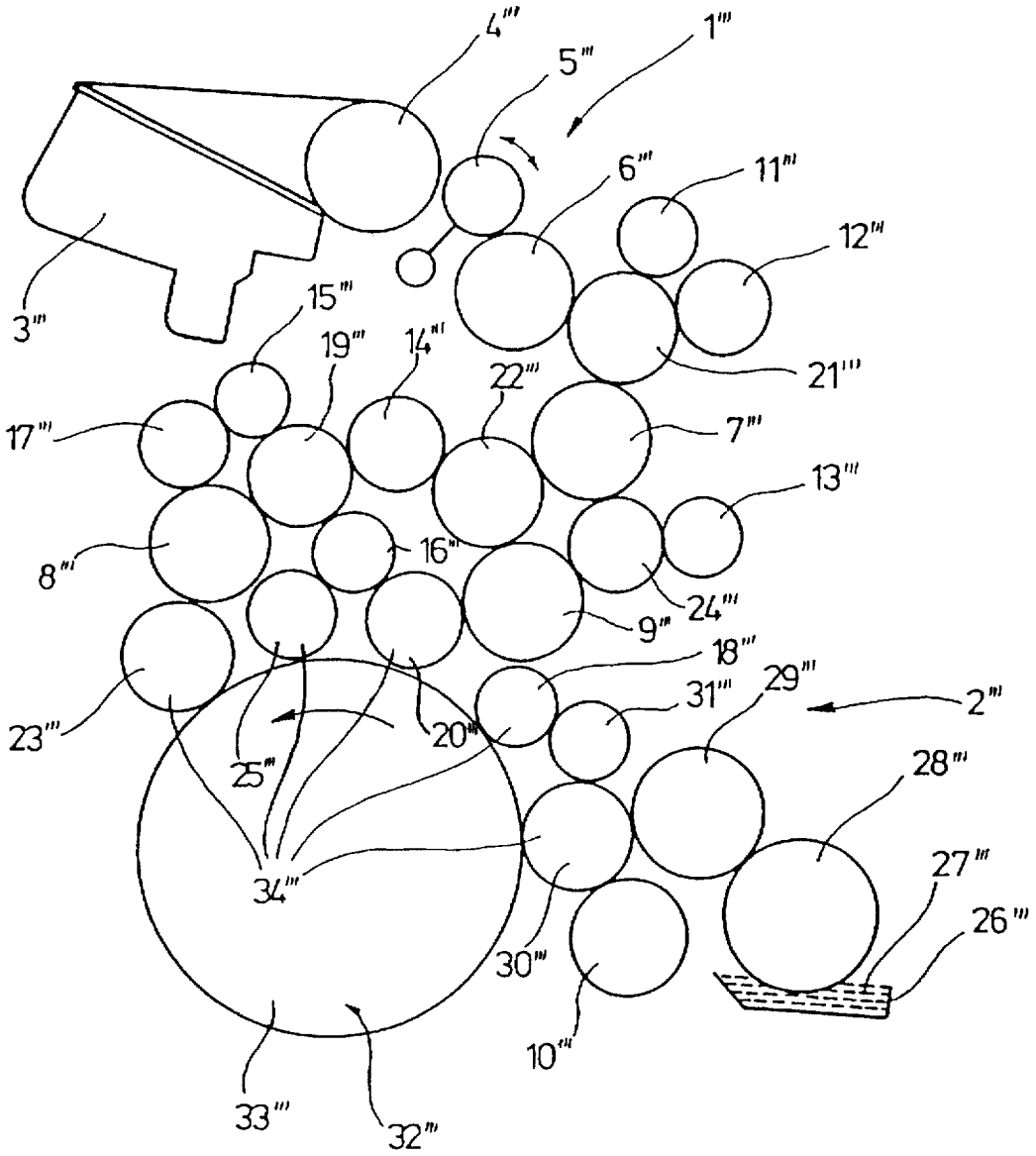
FIG. 10 illustrates an arrangement of rollers and cylinders.

FIG. 10 illustrates another typical arrangement of rollers and cylinders that could conceivably be used in conjunction with at least one preferred embodiment of the present invention. Such an arrangement of rollers and cylinders is described in detail with relation to FIG. 1 of U.S. Pat. No. 5,081,926, which issued to Rodi on Jan. 21, 1992. This U.S. Patent is hereby incorporated by reference herein. The reference numerals set forth in the aforementioned U.S. Patent, with relation to FIG. 1 thereof, are each correspondingly represented in FIG. 10 of the instant application by the same reference numerals, but with the addition of a "triple-prime" symbol. It will be appreciated that rollers 6'", 7'", 8'", 9'" and 10'" illustrated in FIG. 10 are all distributor rollers which could each employ an arrangement such as that described and illustrated heretofore with relation to FIGS. 4–8.

Figure 11:
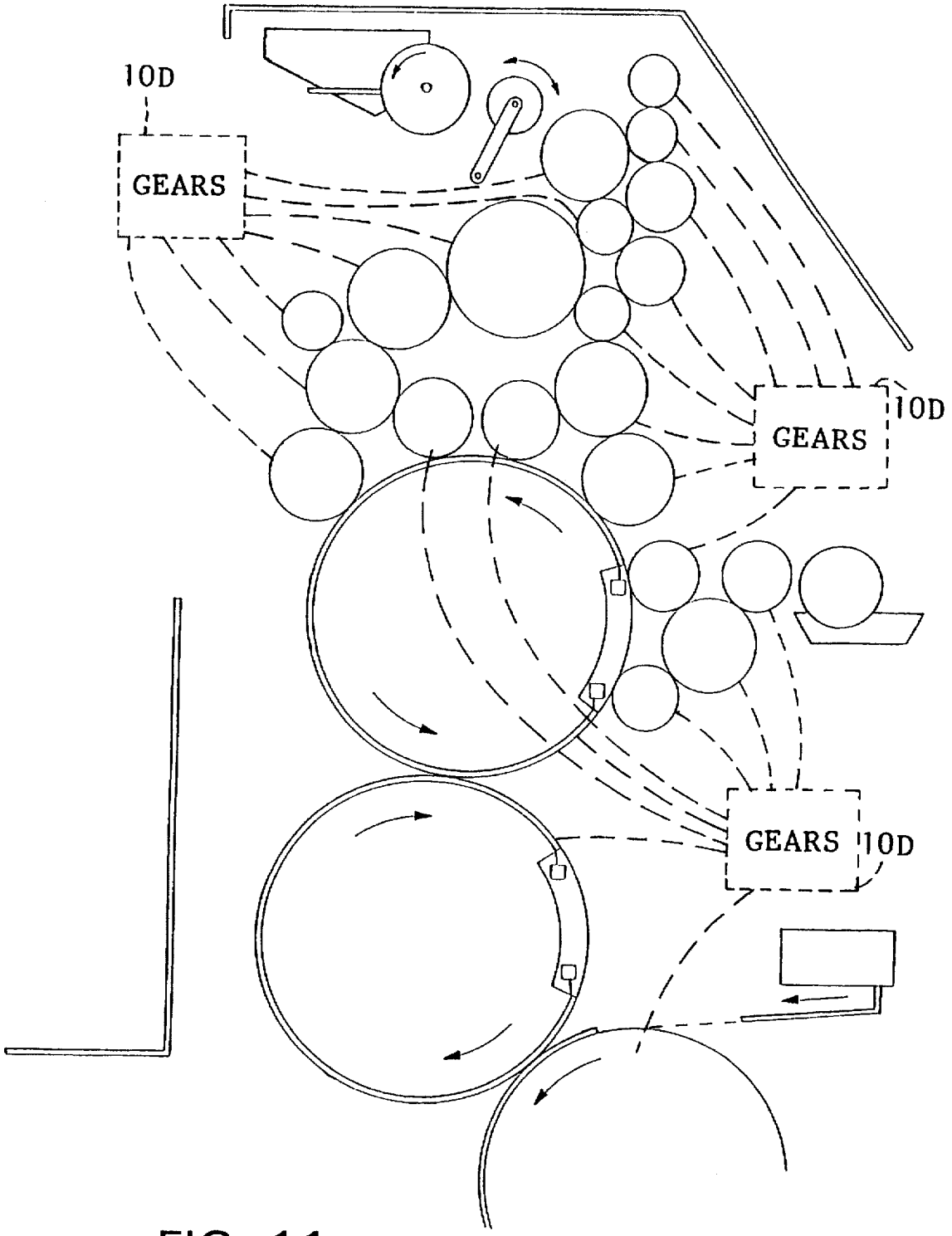
FIG. 11 illustrates a possible arrangement of gears which may be utilized with a print stand, or printing unit, of a rotary printing press.

Referring now to FIG. 11, a rotary print stand of a rotary printing press is schematically illustrated, which rotary print stand can possibly employ various gear mechanisms 10D, according to the present invention.

A subject to be printed, or a printing job, as discussed hereinabove, may be defined as any matter to be printed, such as sheets or a continuous web. That is, a printing job may essentially be constituted by the printing of one or more pages of a manual, pamphlet, or other matter. The terms, "subject to be printed", and "printing job", may also be used in connection with printing involving a single ink or multiple inks, whether the end result is a single page or less, a brochure, a book, etc., or multiples thereof.

If not otherwise stated hereinabove, it should generally be understood that the term, or terms, "print subject", "printing job", "print job", and other variations thereof, as discussed hereinabove with relation to FIGS. 1 through 11 may, if appropriate, essentially be considered to be interchangeable with each other and with similar terminology known to those of ordinary skill in the art.

One feature of the invention resides broadly in the drive for distributor rollers in an inking unit of a rotary printing machine comprising a central gearwheel driven by a printing-unit cylinder, and distributor rollers the drive gears of which are in mesh with the central gearwheel, each of the distributor rollers performing an axial stroke, characterized in that a central gearwheel 1 is designed as a double gearwheel, a first gearwheel 2 being in mesh with a printing-unit cylinder, and a second gearwheel 4 being in mesh with drive gears 5 of distributor roller 6, that the second gearwheel 4 is mounted on a journal 15, that both gearwheels 2, 4 feature a respective internal toothing 23, 24 meshing with a planetary gear 20 having two gear rims 21, 22, the planetary gear being mounted on the journal 15 of the displace able second gearwheel 4, and that both internal toothings 23, 24 with gear rims 21, 22 of the planetary gear 20 differ with respect to the number of their teeth.

Another feature of the invention resides broadly in the drive characterized in that the journal 15 carries a spur gear 26 which, via an intermediate gear 27, may be driven by a servomotor 29 for the adjustment of the point of reversal of the distributor roller, and which rotates the journal 15 together with the planetary gear 20.

Yet another feature of the invention resides broadly in the drive characterized in that the journal 15 carries a bearing plate 30, that the servomotor is fastened to the bearing plate 30, and that there is provided an adjusting cylinder 35 which acts on the bearing plate 30 and axially displaces the bearing plate 30 together with the second gearwheel 4 of the central gearwheel 1 so that the planetary gear 20 is disengageable from the internal toothing 24 and the inking-unit drive may be brought to a standstill.

Still another feature of the invention resides broadly in the drive characterized in that, in order to be fixed against rotation, the bearing plate 30 features a guide slit 34 into which engages a roller 32 mounted so as to be fastened to the machine frame.

A further feature of the invention resides broadly in the drive characterized in that a rotary-position indicator 37 driven via a pair of gearwheels 38, 39 is assigned to the journal 15.

The appended drawings in their entirety, including all dimensions, proportions and/or shapes in at least one embodiment of the invention, are accurate and to scale and are hereby included by reference into this specification.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS

1. central gearwheel
2. gearwheel
3. spur gear
4. gearwheel
5. drive gear
6. distributor roller
7. ball bearing
8. bearing body
9. screw
10. machine side frame
11. support bolt
12. bearing plate
13. ball bearing
14. needle bearing
15. journal
16. journal
17. bearing
18. recess
19. bearing body
20. planetary gear
21. gear rim
22. gear rim
23. internal toothing
24. internal toothing
25. journal end
26. spur gear
27. intermediate gearwheel
28. drive gear
29. servomotor
30. bearing plate
31. ball bearing
32. roller
33. holding means
34. guide slit
35. adjusting cylinder
36. piston rod
37. rotary-piston indicator
38. gearwheel
39. gearwheel
40. gear

What is claimed is:

1. A drive for a distributor roller in an inking unit of a rotary printing press, said drive comprising:

a central gearwheel assembly comprising:

a first gearwheel, said first gearwheel having internal gear teeth;

said first gearwheel being disposed to be driven by a printing-unit cylinder;

a second gearwheel, said second gearwheel having internal teeth;

said second gearwheel being disposed to be operatively connected to the distributor roller;

a planetary gear system disposed to mesh with said first gearwheel and said second gearwheel;

said planetary gear system having a first gear rim and a second gear rim;

each of said first and second gear rims comprising gear teeth;

said internal gear teeth of said first gearwheel being in mesh with said gear teeth of said first gear rim;

said internal gear teeth of said second gearwheel being in mesh with said gear teeth of said second gear rim; and said first gear rim having a different number of gear teeth than said second gear rim.

2. A drive as claimed in claim 1 comprising:

a journal;

said second gearwheel being mounted on said journal; and said planetary gear system being mounted on said journal.

3. A drive as claimed in claim 2 comprising:

a spur gear being disposed on said journal;

the distributor roller being configured to have an axial stroke which axial stroke has a point of reversal limiting motion of the distributor roller; a servomotor; and said servomotor being operatively connected to said spur gear to adjust the point of reversal of the axial stroke of the distributor roller by rotating said journal and said planetary gear system.

4. A drive as claimed in claim 3 comprising:

a bearing plate;

said bearing plate being disposed on said journal;

said servomotor being connected to said bearing plate;

an adjusting cylinder; and said adjusting cylinder being disposed to axially displace said bearing plate and said second gearwheel, to disengage said planetary gear from said second gearwheel.

5. A drive as claimed in claim 4 comprising:

a frame;

a roller;

said bearing plate comprises a guide slit;

said roller being disposed to engage with said guide slit; and said roller being mounted on said frame to prevent rotation of said bearing plate.

6. A drive as claimed in claim 5 comprising:

a rotary position indicator;

said rotary position indicator being operatively connected to said journal to indicate an angular postion of said journal.

7. A printing press comprising:

a frame;

a printing unit cylinder for mounting a printing plate;

said printing unit cylinder being rotatably mounted with respect to said frame;

an ink reservoir for holding a supply of ink;

an inking mechanism for transferring the ink between said ink reservoir and said printing unit cylinder during operation of said printing press;

said inking mechanism comprising a plurality of inking rollers for transferring ink from said ink reservoir to said printing unit cylinder;

a blanket cylinder being rotatably mounted with respect to said frame and being engageable with said printing unit cylinder during operation of said printing press;

a distributor roller for being engaged with at least one of said inking rollers during operation of said printing press;

said distributor roller having a rotational axis and being mounted, with respect to said frame, for rotation about the rotational axis;

a gear system for driving said distributor roller and said printing unit cylinder;

an oscillator for displacing said distributor roller, simultaneously with the rotation of the distributor roller, in a direction substantially parallel to the rotational axis of said distributor roller and to laterally oscillate said distributor roller over a lateral stroke;

angular position varying gearing for selectively and determinably varying the angular position of said distributor roller with respect to the angular position of said printing unit cylinder to thus vary the starting point of the lateral stroke of said distributor roller with respect to a predetermined portion of a printing plate disposed on said printing unit cylinder; and said angular position varying gearing comprising gearing to vary the angular position of said printing unit cylinder with respect to said distributor roller from a first printing job to an immediately succeeding, second, printing job during operation of said printing press without shutting down said printing press or intervening manually with said gear system of said printing press.

8. The printing press according to claim 7, wherein: said gearing to vary the angular position of said printing unit cylinder with respect to said distributor roller from a first printing job to an immediately succeeding, second, printing job during operation of said printing press without shutting down said printing press or intervening manually with said gear system of said printing press comprises motor means for varying the angular position of said printing unit cylinder with respect to said distributor roller;

said gear system comprises:

a gearwheel assembly;

at least one additional gearwheel; and a planetary gearwheel;

said gearwheel assembly comprising a first gearwheel and a second gearwheel;

said first gearwheel having an axis of rotation;

said second gearwheel having an axis of rotation;

said at least one additional gearwheel having an axis of rotation;

said first gearwheel being operatively connected to said plate cylinder;

said second gearwheel being connected to said at least one additional gearwheel;

said at least one additional gearwheel being connected to drive said distributor roller;

said second gearwheel being displacable along the axis of rotation of said second gearwheel;

said first gearwheel having an internal portion and an external portion;

said external portion of said first gearwheel being disposed farther from the axis of rotation of said first gearwheel than said internal portion of said first gearwheel;

said second gearwheel having an internal portion and an external portion;

said external portion of said second gearwheel being disposed farther from the axis of rotation of said second gearwheel than said internal portion of said second gearwheel;

said planetary gear wheel comprising a first gear rim and a second gear rim;

said first gear rim being disposed adjacent said second gear rim;

said first gear rim comprising a first set of teeth for meshing with said internal portion of said first gearwheel;

said second gear rim comprising a second set of teeth for meshing with said internal portion of said second gearwheel; and said printing press further comprising means for disengaging and re-engaging said at least one additional gearwheel with said gearwheel assembly.

9. The printing press according to claim 8 comprising:

a journal;

said second gearwheel being mounted on said journal;

said planetary gear wheel being mounted on said journal;

said second gearwheel being axially displacable along the axis of rotation of said second gearwheel to operatively engage and disengage said second gearwheel from said first gearwheel;

said internal portion of said first gearwheel and said first gear rim being disposed to mesh with one another in a first position;

said internal portion of said first gearwheel and said first gear rim having a first gear ratio;

said internal portion of said second gearwheel and said second gear rim being disposed to mesh with one another;

said internal portion of said second gearwheel and said second gear rim having a second gear ratio; and said first gear ratio being different than said second gear ratio.

10. The printing press according to claim 9, wherein:

said printing press further comprises a spur gear and a servomotor;

said journal carries said spur gear;

said spur gear is disposed to be driven by said servomotor for the adjustment of the point of reversal of said distributor roller, which rotates said journal together with said planetary gear wheel.

11. The printing press according to claim 9, wherein:

said printing press further comprising a bearing plate and an adjusting cylinder;

said printing press comprises a servomotor;

said journal carries said bearing plate;

said servomotor is fastened to said bearing plate;

said adjusting cylinder acts on said bearing plate and axially displaces said bearing plate together with said second gearwheel; and said planetary gear is disengageable from said internal portion to thereby bring said inking mechanism to a standstill.

12. The printing press according to claim 10, wherein:

said printing press further comprises a bearing plate and an adjusting cylinder;

said journal carries said bearing plate;

said servomotor is fastened to said bearing plate;

said adjusting cylinder acts on said bearing plate and axially displaces said bearing plate together with said second gearwheel; and said planetary gear wheel is disengageable from said internal portion to thereby bring said inking mechanism to a standstill.

13. The printing press according to claim 11, wherein:

said printing press further comprises a roller;

said bearing plate comprises a guide slit;

said guide slit engages said roller;

said roller being mounted so as to be fastened to the machine frame, and fixes said bearing plate against rotation.

14. The printing press according to claim 12, wherein:

said printing press further comprises a roller;

said bearing plate comprises a guide slit;

said guide slit engages said roller;

said roller being mounted so as to be fastened to a frame, and fixes said bearing plate against rotation.

15. The printing press according to claim 9, wherein a rotary-position indicator driven via a pair of gearwheels is assigned to said journal.

16. A drive to reciprocate a distributor roller in an inking unit of a rotary printing press, said drive comprising:

a central gearwheel assembly comprising:

a first gearwheel, said first gearwheel having internal teeth;

said first gearwheel being disposed to be driven by a printing-unit cylinder;

a second gearwheel, said second gearwheel having internal teeth; and said second gearwheel being disposed to be operatively connected to the distributor roller;

a planetary gear system disposed to mesh with said first gearwheel and said second gearwheel;

said planetary gear system having a first gear rim and a second gear rim;

each of said first and second gear rims comprising gear teeth;

said internal gear teeth of said first gearwheel being in mesh with said gear teeth of said first gear rim;

said internal gear teeth of said second gearwheel being in mesh with said gear teeth of said second gear rim; and said first gear rim having a different number of gear teeth than said second gear rim.

17. A drive as claimed in claim 16 comprising:

a journal;

said second gearwheel being mounted on said journal; and said planetary gear system being mounted on said journal.

18. A drive as claimed in claim 17 comprising:

a spur gear being disposed on said journal;

a servomotor; and said servomotor being operatively connected to said spur gear to adjust the point of reversal of the axial stroke of the distributor roller by rotating said journal and said planetary gear system.

19. A drive as claimed in claim 18 comprising:

a bearing plate;

said bearing plate being disposed on said journal;

said servomotor being connected to said bearing plate;

an adjusting cylinder; and said adjusting cylinder being disposed to axially displace said bearing plate and said second gearwheel, to disengage said planetary gear system from said second gearwheel.

20. A drive as claimed in claim 19 comprising:

a frame;

a roller;

said bearing plate comprises a guide slit;

said roller being disposed to engage said guide slit;

said roller being mounted on said frame to prevent rotation of said bearing plate;

a rotary position indicator;

said rotary position indicator being operatively connected to said journal to indicate the angular position of said journal.

* * * * *

UNITED STATES PATENT AND TRADEMARK OFFICE

CERTIFICATE OF CORRECTION

PATENT NO. : 5,713,280

DATED : February 3, 1998

INVENTOR(S) : Carsten KELM and Rainer KLENK

It is certified that error appears in the above-identified patent and that said Letters Patent is hereby corrected as shown below:

On the title page, item [73], before 'Heidelberg', delete "Aktiengessellschaft," and insert --Aktiengesellschaft,--.

In column 1, line 58, after 'is', delete "derivable" and insert --drivable--.

In column 5, line 49, after 'roller', delete " 7" " and insert --17"--.

In column 6, line 20, after 'swing', delete " 12' " and insert --12"--.

In column 8, line 17, after 'at', delete "32a," and insert --32a',--.

Signed and Sealed this

Second Day of June, 1998

*Attest:*

Bruce Lehman

BRUCE LEHMAN

*Attesting Officer*

*Commissioner of Patents and Trademarks*